United States Patent [19]

Archambault

[11] 4,449,963

[45] May 22, 1984

[54] MACHINE FOR FOLDING LARGE-SIZE DRAWINGS OR DOCUMENTS

[75] Inventor: Marcel Archambault, Tours, France

[73] Assignee: Chapel Reprographie, Saint-Alban-Leysse, France

[21] Appl. No.: 367,902

[22] Filed: Apr. 13, 1982

[30] Foreign Application Priority Data

Apr. 4, 1981 [FR] France ..... 81 07005

[51] Int. Cl.[3] ..... B65H 45/20

[52] U.S. Cl. ..... 493/414

[58] Field of Search ..... 270/30; 493/409–415, 493/457

[56] References Cited

U.S. PATENT DOCUMENTS 1,877,359 9/1932 Morin ..... 493/414 X 3,496,698 2/1970 Wichmann ..... 493/415 X

FOREIGN PATENT DOCUMENTS 572783 11/1958 Belgium ..... 493/413

*Primary Examiner*—A. J. Heinz

*Attorney, Agent, or Firm*—Schiller & Pandiscio

[57] ABSTRACT

A machine for folding drawings or documents, comprising hinged blade-holder arms with opposed blades which can be moved back and forth to alternately form the folds of a drawing inserted between them against folding and stop surfaces which work with fold-forming and fold-holding presser components. The improvement comprises the folding and stop surfaces are formed by two half-platens (17, 20) mounted to pivot about pins (18, 19) parallel to the hinge pins (2, 36) of the blade-holder arms (11, 27) and fixed to levers (5, 34). The levers are acted on by cams (3, 37) fixed to the arms (11, 27) hinge pins (2, 36) and designed so that one half-platen presses the drawing or any fold formed at its position against the corresponding presser components (14 or 23) while the other remains free to swing on insertion of the blade (12 or 25) and the corresponding drawing fold to be formed between it and the corresponding presser components.

Preferably, the presser components (14, 23) are mounted floating and pulled by springs (10, 28) towards the folding and stop surfaces of each half-platen.

6 Claims, 14 Drawing Figures

23
20
17
25
27
15
14
11
16
32
33
34
35
36
37
42
40
41
39

MACHINE FOR FOLDING LARGE-SIZE DRAWINGS OR DOCUMENTS

The invention relates to manual machines for large-size drawings and documents. It is known that drawings are folded according to a standard which requires that, after folding, the document in particular has a size of 210 mm×297 mm.

In machines of this type pressers are used to grip the paper and compress the folds made the pressers are returned to pressure by a spring and release device at the moment when a folding blade finishes inserting the paper beneath the presser involved.

At that instant the presser comes into violent contact with the blade, from which it is separated by only the thickness of the paper. The sudden application of the presser against the blade therefore produces a loud sharp noise. Since these machines are used in office premises these repeated sharp smacks can be a nuisance.

Further, in the prior art system mentioned, the need to make the violent closure of the presser coincide exactly with the arrival of the blade at the end of its stroke, means that, in addition to the large number of parts in the mechanism, this mechanism imposes adjustment operations, and the time devoted to such operations weighs on the cost and leads to risks of subsequent maladjustment of maintenance operations during utilization.

An object the present invention is to substantially reduce or eliminate noise associated with the operation of the prior art system.

A second object of the present invention is to simplify the manufacture of the machine by reducing the number of parts in the proposed mechanism, as well as eliminating adjustments in production and servicing operations.

Basically, to this end, the drawing folding machine of the present invention comprises hinged blade-holder arms with opposed blades movable back and forth to alternately form the folds of a drawing inserted between them against folding and stop surfaces which the latter working fold-forming and fold-holding presser components. The machine is characterized in that the folding and stop surfaces are formed by two half-platens mounted to swing above pins parallel to the hinge pins of the blade-holder arms the platens are fixed to levers acted on by cams fixed to the arm hinge pins and designed so that one half-platen presses the drawing or any fold formed at its position against the corresponding presser components, whilst the other remains free to swing relative to the corresponding presser components on insertion of the blade and of the corresponding drawing fold to be formed between the second mentioned half-platen and the corresponding presser components.

Preferably according to the invention the machine is further characterized in that the presser components are mounted so as to float and are pulled by springs towards the folding and stop surface of each half-platen and, also, in that the presser components are provided with stays normally resting on seatings spaced from the corresponding half-platen these, stays can be operated to retract responsively to the blades on formation of each fold.

Other aspects of the invention will also be revealed in the following description of an embodiment of such a machine shown in the appended drawings, as a non-exclusive example. In the drawings.

Figure 1:
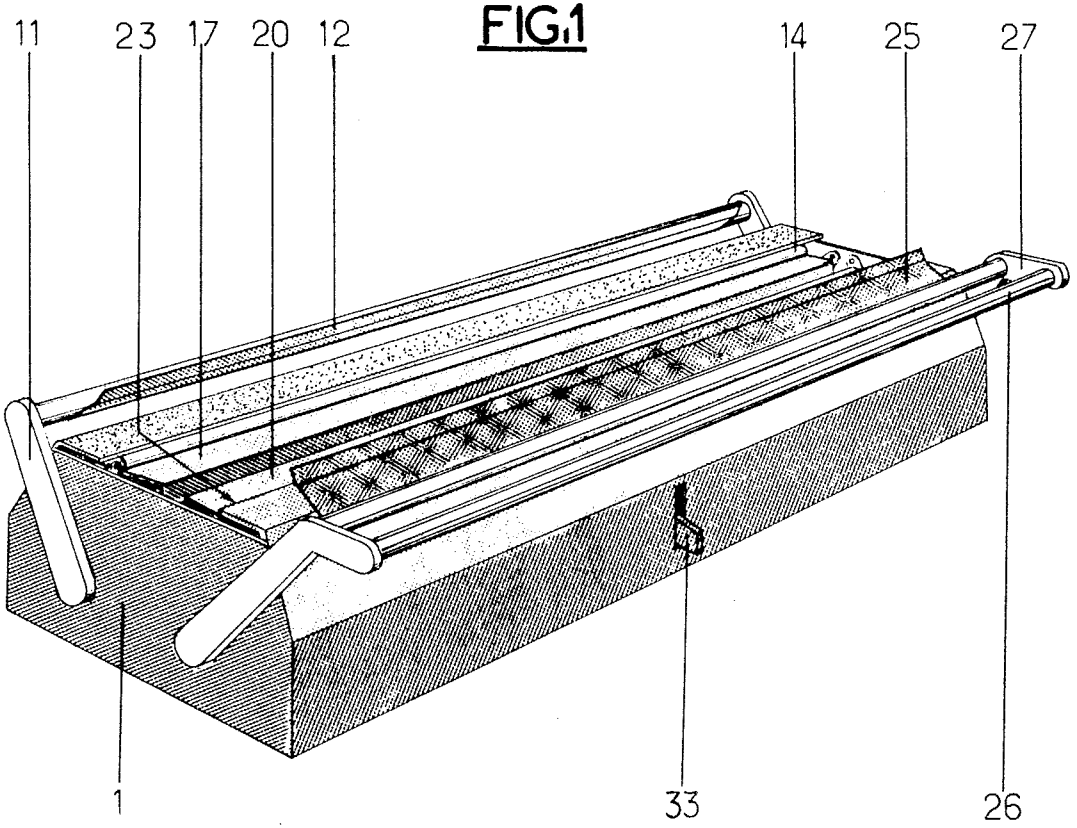
FIG. 1 is an external perspective view of the overall machine.

The machine shown comprises a casing inside whose side plates 1 two pins 2, 36 are mounted to rotate parallel to each other and have ends which carry and are fixed to two pairs of hinged arms 11, 27. The arm pair 27 is longer than arm pair 11 and is linked by an operating handle tube 26. Each of the arm pairs 11, 27 is furthermore braced above the casing by a tube carrying a folding blade, 12 for arms 11 and 25 for arms 27. In a central upper opening in the casing are placed two half-platens 17, 20 forming the folding and stop surfaces for the drawings to be folded as will be seen later. These half-platens 17, 20 are respectively mounted to swing on the ends of angles **17*a*, 20*a* which support them, through corner pieces 18*a*, 19*a* and pins 18, 19 supported by the side plates 1 and which are parallel to the hinge pins 2 and 36 of the blade-holder arms 11, 27. Hanging levers 5, 34 are respectively attached beneath the angles 17*a* and 20*a* and are provided with rollers 4, 35 which work in conjunction respectively with two cams 3 and 37 fitted on the hinge pins 2, 36 of the blade-holder arms 11, 27. These cams are also fixed to levers 3*a*, 37 respectively, with lever 3*a* having a pin 6 for hinging a latch 39 which comprises a notch for coupling with a link finger 32 on lever 37*a*, so that, when these levers are coupled together the two blade-holders can be operated together by means of the operating handle 26. An unlocking lever 33 is hinged in the casing round a pin 33*a*, the individual support of which is not shown here, and it is provided with a central pin 38 hinging two levers 8, 30 the free ends of which are fork-shaped and engage with fingers 7, 31 fixed to levers 5, 34 controlling the half-platens. Lever 33 protrudes outside the casing so it can be operated by the user as he wishes. The half-platens 17, 20 form the folding and stop surfaces work with presser components 14, 23, the latter extending above them components 14, 23 are shaped as leaves curved facing the half-platens and their vertical stop flanges are inserted to be floating between supports 13, 13*a* and 24, 24*a* placed along the upper opening of the casing. These presser components 14, 23 are respectively supported at their ends by round pins 14*a*, 23*a* which in turn are supported by hinged support stays 15, 22 working with seatings 16, 21 fitted on the inside wall of the casing end plates 1. Extension springs 10, 28 are attached to these pins 14***a*, 23*a* and also fastened to pins 9, 29 carried by the end plates 1 which also act as operating stops for the corresponding blade-holder arms 11, 27. The purpose of springs 10 and 28 is to hold the pressers 14 and 23 up against the vertical flange of the half-platens 17 and 20 at all times, which ensures that the half-platens are correctly positioned. These springs are also used to pull the pressers back down to perform the initial fold formation and thereafter prevent the paper from escaping during the reverse movement of the blade.

Figure 2:
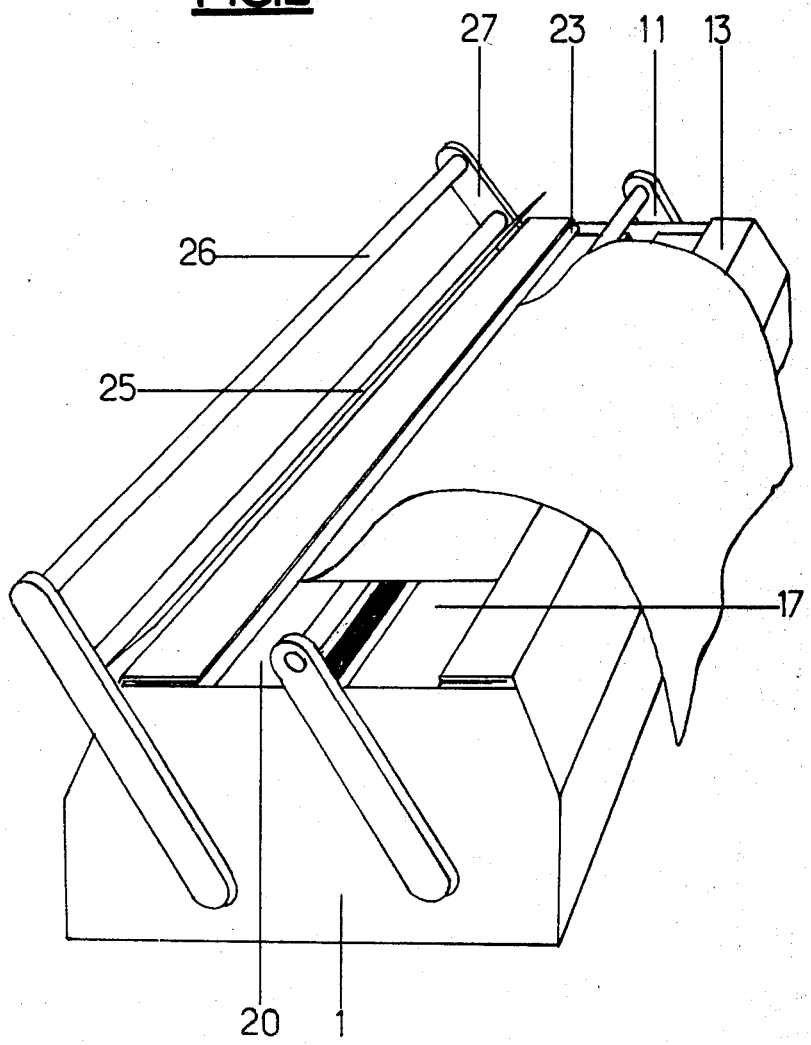
FIG. 2 is another perspective view showing a document being folded in position.
Figure 3:
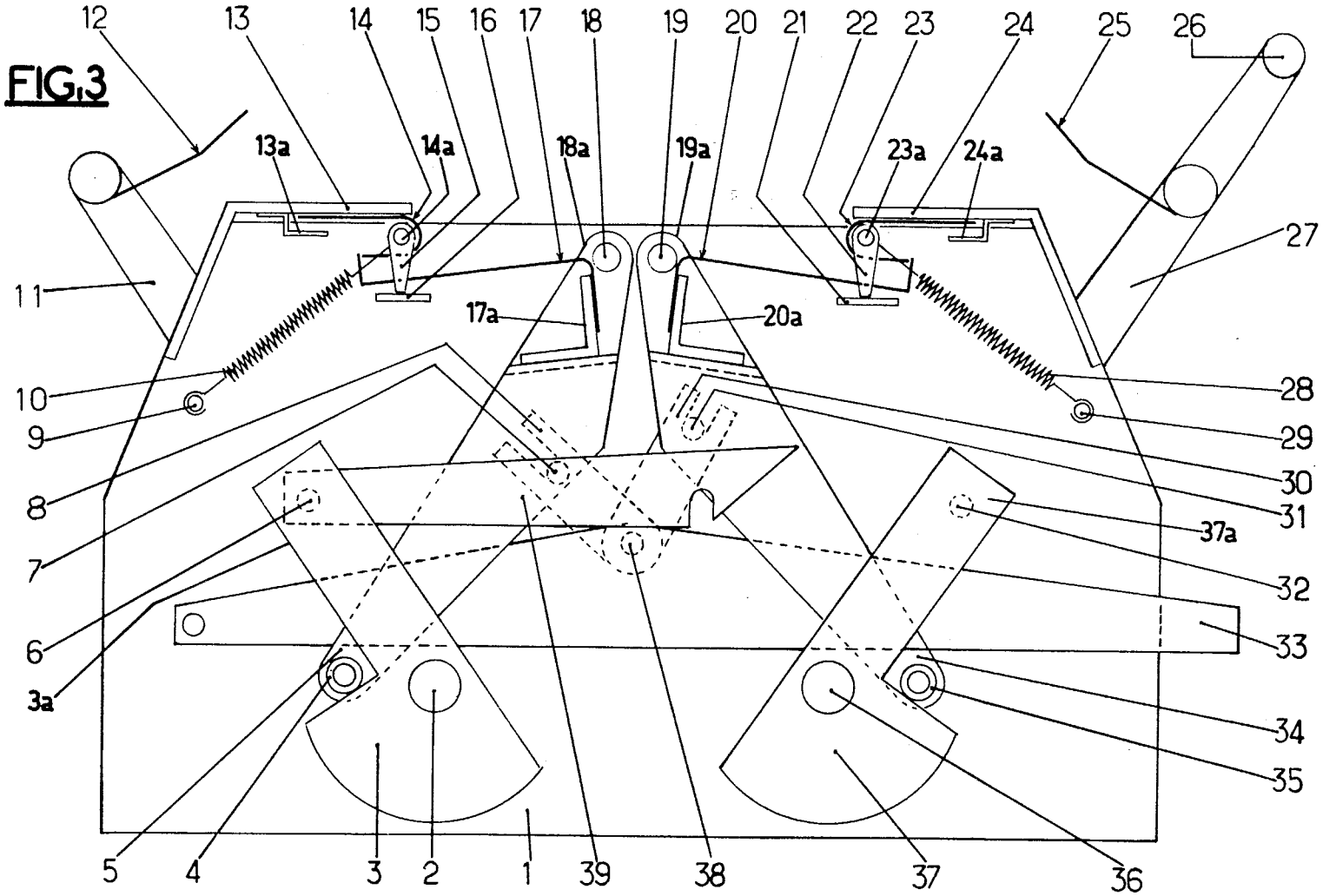
FIG. 3 is a side elevation view of the machine which is assumed to have had a side plate removed to reveal the internal parts.
Figure 4:
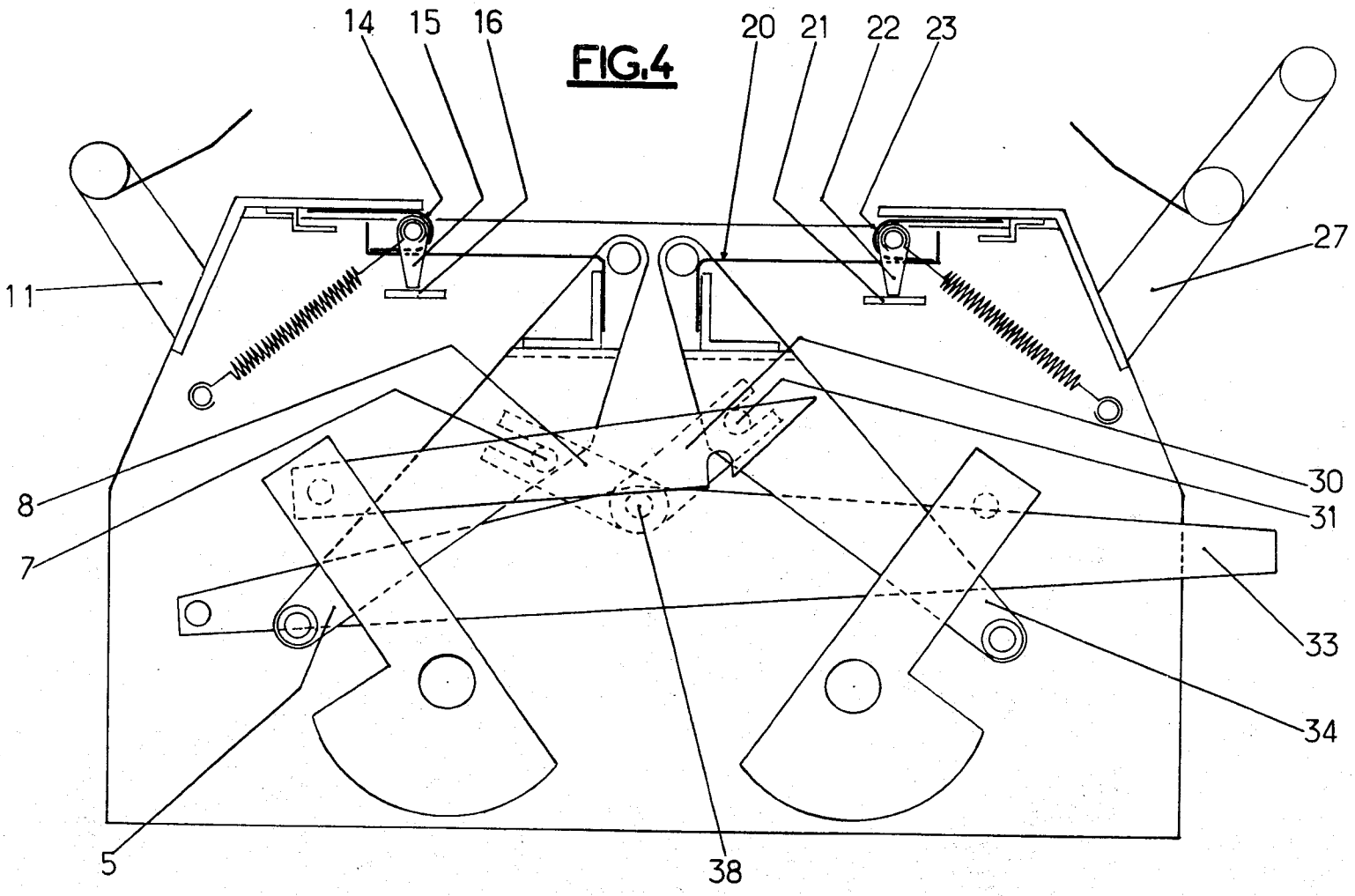
FIGS. 4 to 7 are side elevation views similar to FIG. 3 but showing other stages in the machine's operation.
Figure 5:
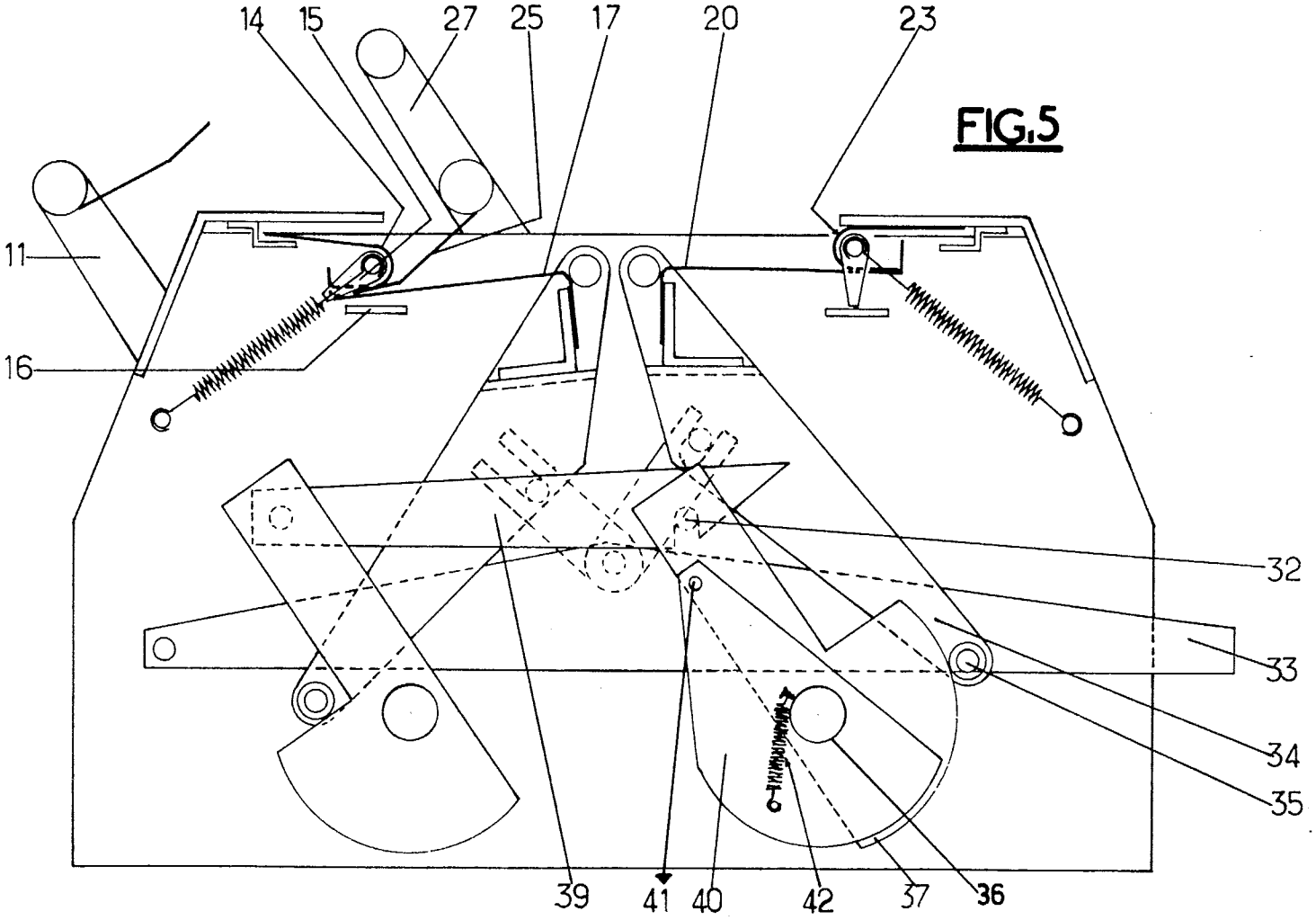

The application and working of this type of machine are set out below referring to the various figures illustrating different phases; however they do not show the drawing being folded so that the illustration is clearer, save in FIG. 2 which illustrates the case of a document being folded. Since the machine is considered to be designed for one operator placed on the side of the blade-holder arm 27 with the operating handle 26 in order to serve it, it should be considered that initially at the beginning of operation, as shown in FIGS. 1 and 3, the front 27 and back 11 blade-holder arms are uncoupled from each other and the pressers 14 and 23 are held in the raised position by their respective stays 15 and 22 which rest on the seatings 16 and 21, whilst the half-platens 17 and 20 are in the lower position shown. The end of the document to be folded can then be inserted between the front presser 23 and the corresponding half-platen 20. The lever 33 is then raised manually by the operator so that, as shown in FIG. 4, the central pin 38 raises levers 8 and 30 which in turn push fingers 7 and 31 and separate levers 5, 34 controlling the half-platens, which results in raising the half-platens about their swing pins. In particular the half-platen 20 consequently grips the end of the document which has been inserted between it and the presser 23. This same movement ensures the above-mentioned initial positions of the pressers 14 and 23 are established, since, by pressing the half-platens against the pressers, it ensures the stays 15 and 22 are wedged on the seatings 16 and 21 as shown. With the document stretching between the two blades, the blade-holder arm 27 with the operating handle 26 is then pushed forward. The cam 37, which is fixed to arm 27, then comes and presses on the roller 35 and lever 34, which results in holding the half-platen 20 pressed firmly against the corresponding presser 23 therefore preventing the corresponding end of the drawing from slipping. At the same time the lever 33 is released by the user, which allows the back half-platen 17 to drop and thus make the space required for inserting blade 25 when it is about to come and push the document between the presser 14 and this back half-platen 17, at the end of the backwards travel of blade-holder arm 27. As FIG. 5 shows, on reaching the end of its travel the blade 25 has pushed the stay 15 of presser 14 and this stay 15 escapes from its seating 16 and allows the presser 14 to press against the document and the blade 25, which will prevent the paper from following the blade 25 in its subsequent return movement. But, since the presser travel is very short, this gripping action causes virtually no noise. In the same movement the finger 32 of lever 37 has lifted the latch 39 and entered its slot, thus locking the front 27 and back 11 blade-holder arms together as shown in FIG. 5, which thus corresponds to the position for making the first document fold.

Figure 6:
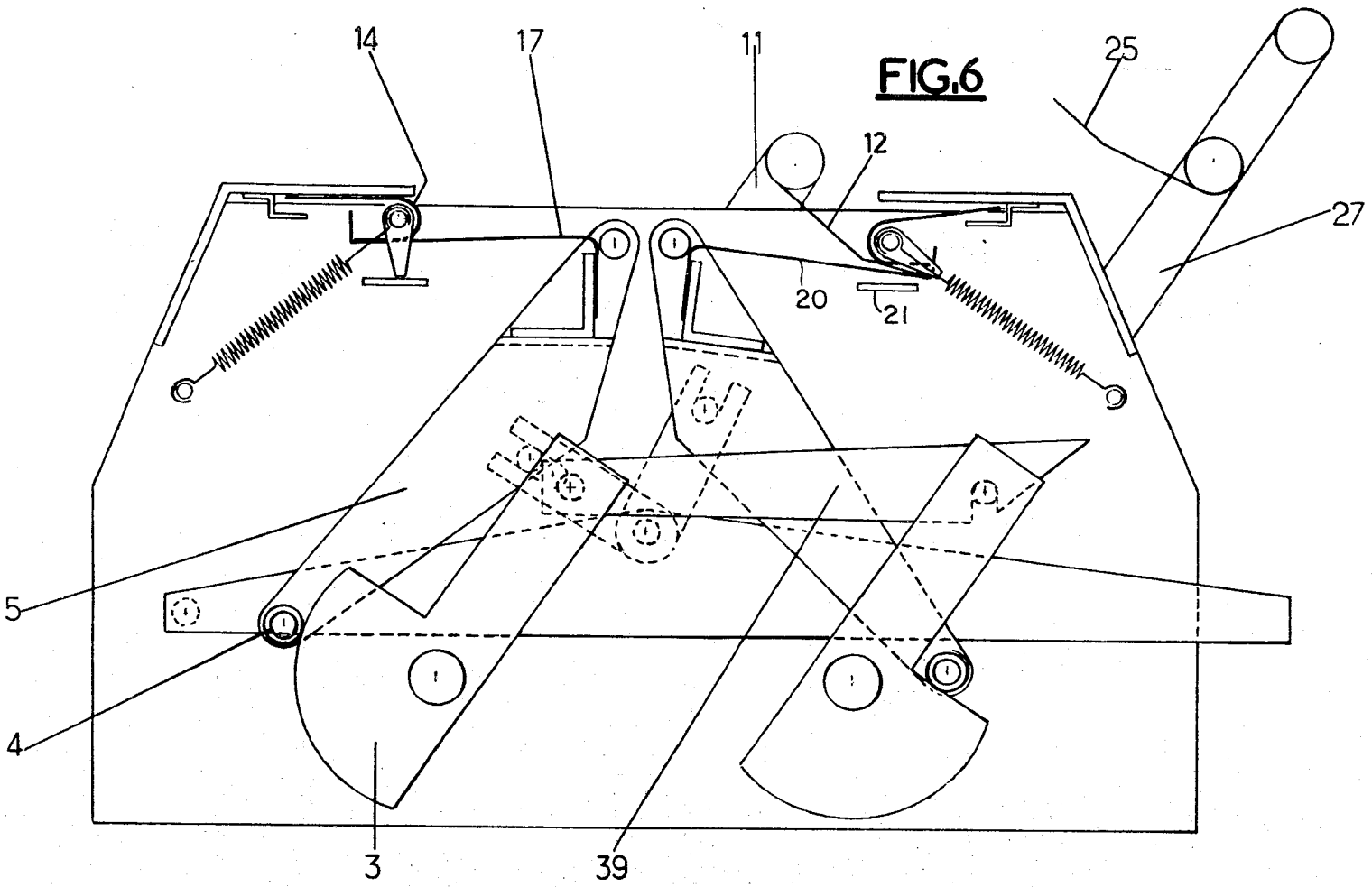
Figure 7:
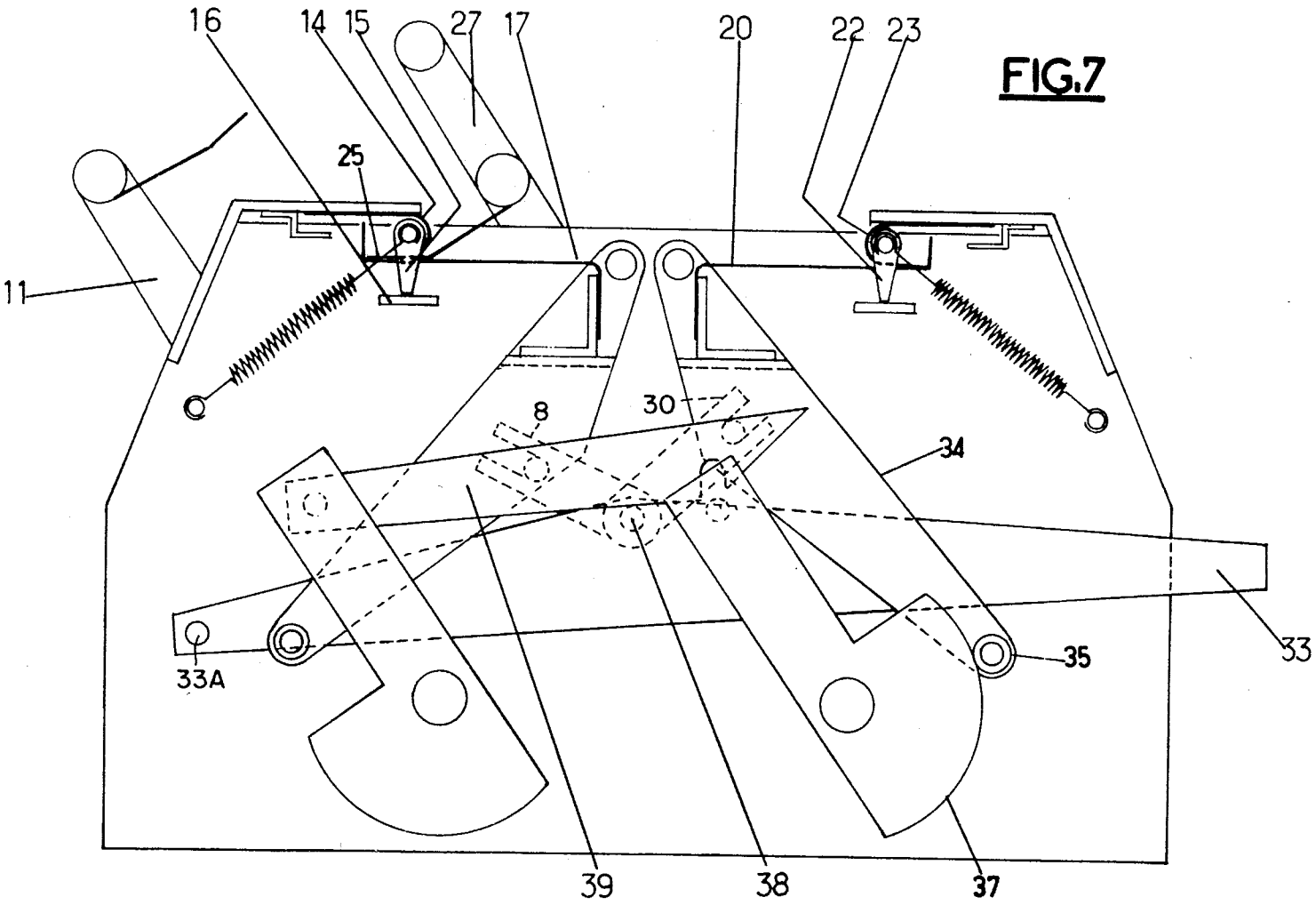
Figure 8:
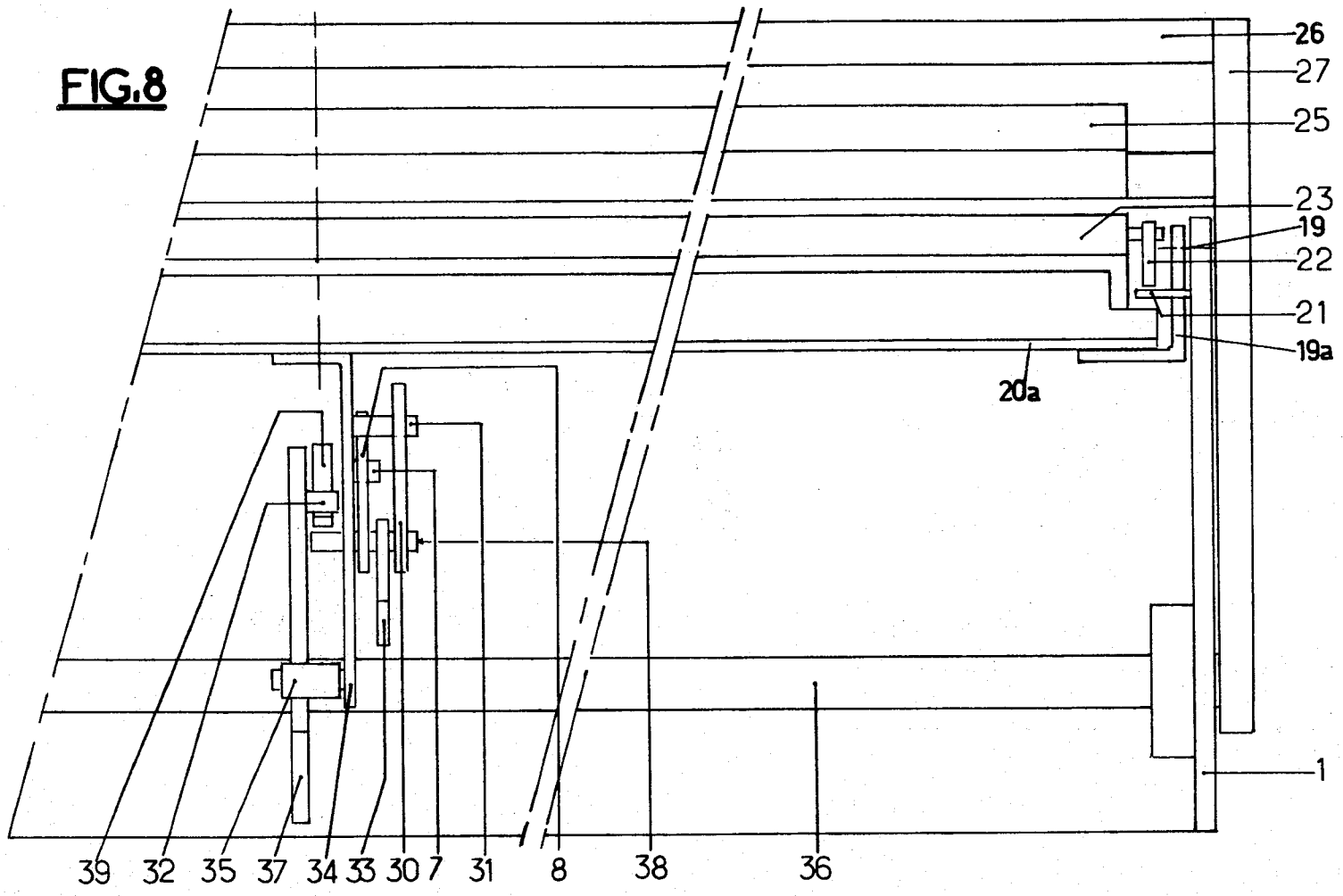
FIG. 8 is a front elevation view of the machine's internal mechanism and of the end assembly of some of its components, with the corresponding casing wall assumed to have been removed.
Figure 9:
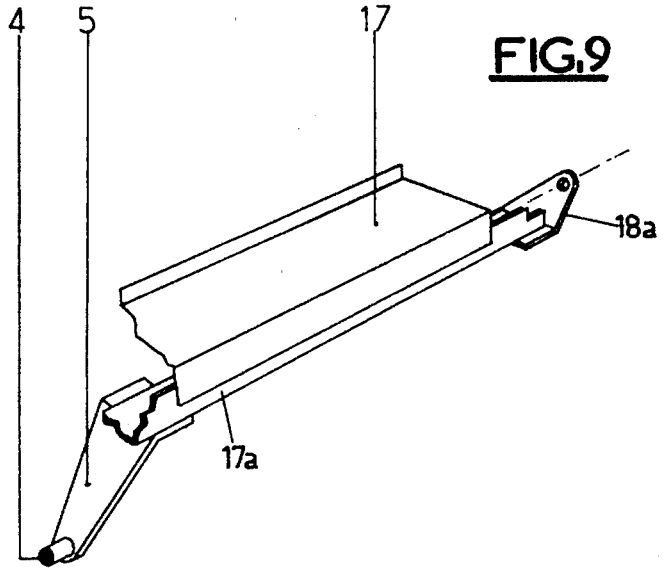
FIG. 9 is an exploded perspective view of a half-platen.
Figure 10:
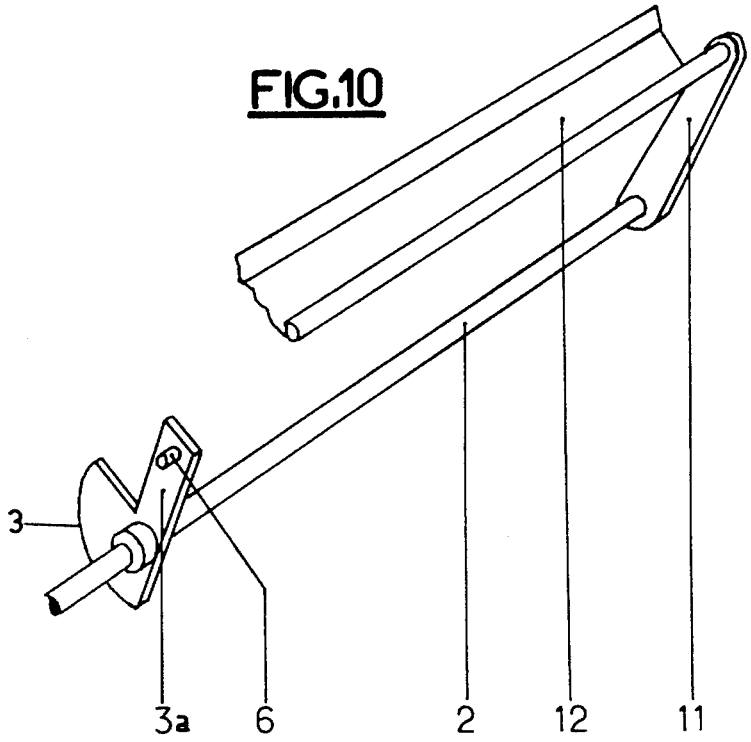
FIG. 10 is an exploded perspective view of a blade-holder arm and control cam sub-assembly.
Figure 11:
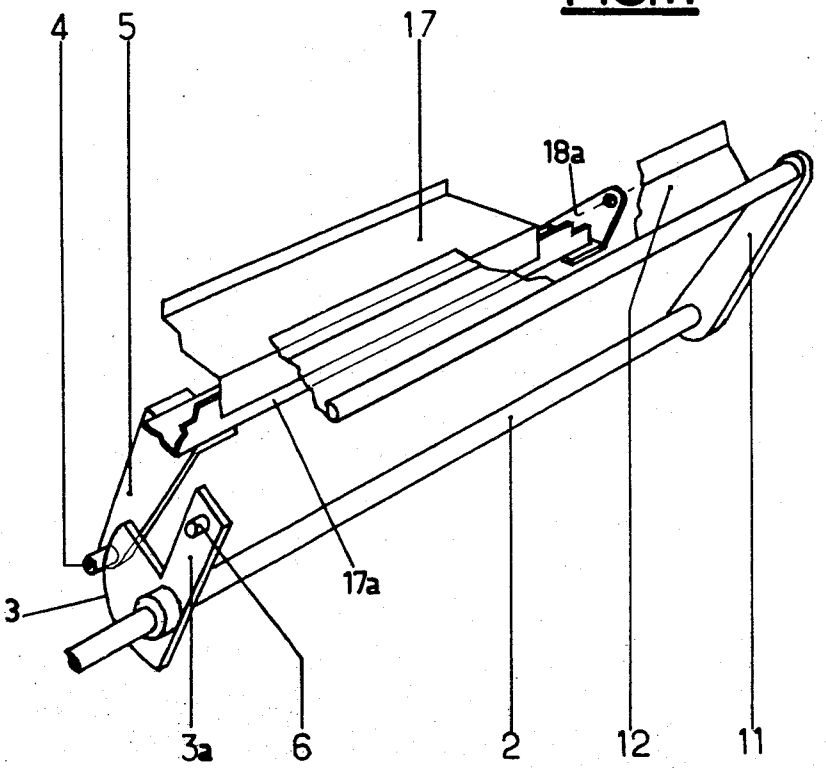
FIG. 11 is a perspective view of the sub-assemblies involved in FIGS. 9 and 10.
Figure 12:
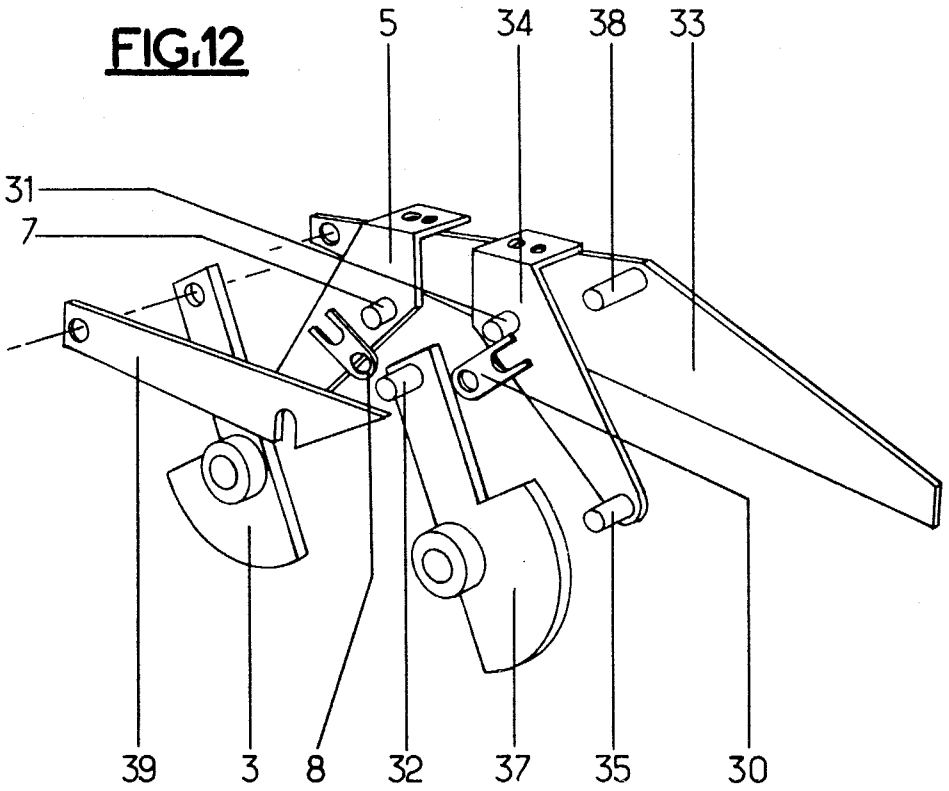
FIG. 12 is an exploded view of the said internal mechanism.
Figure 13:
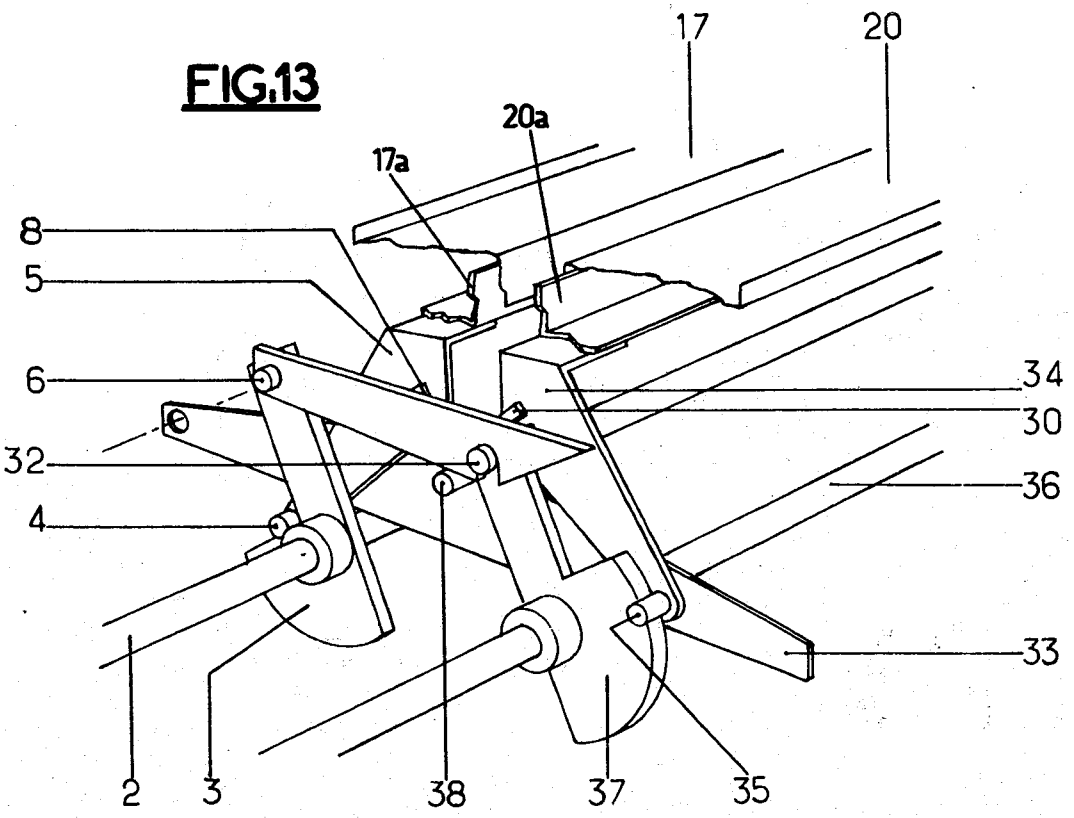
FIG. 13 is a perspective view of the internal mechanism in the assembly position.
Figure 14:
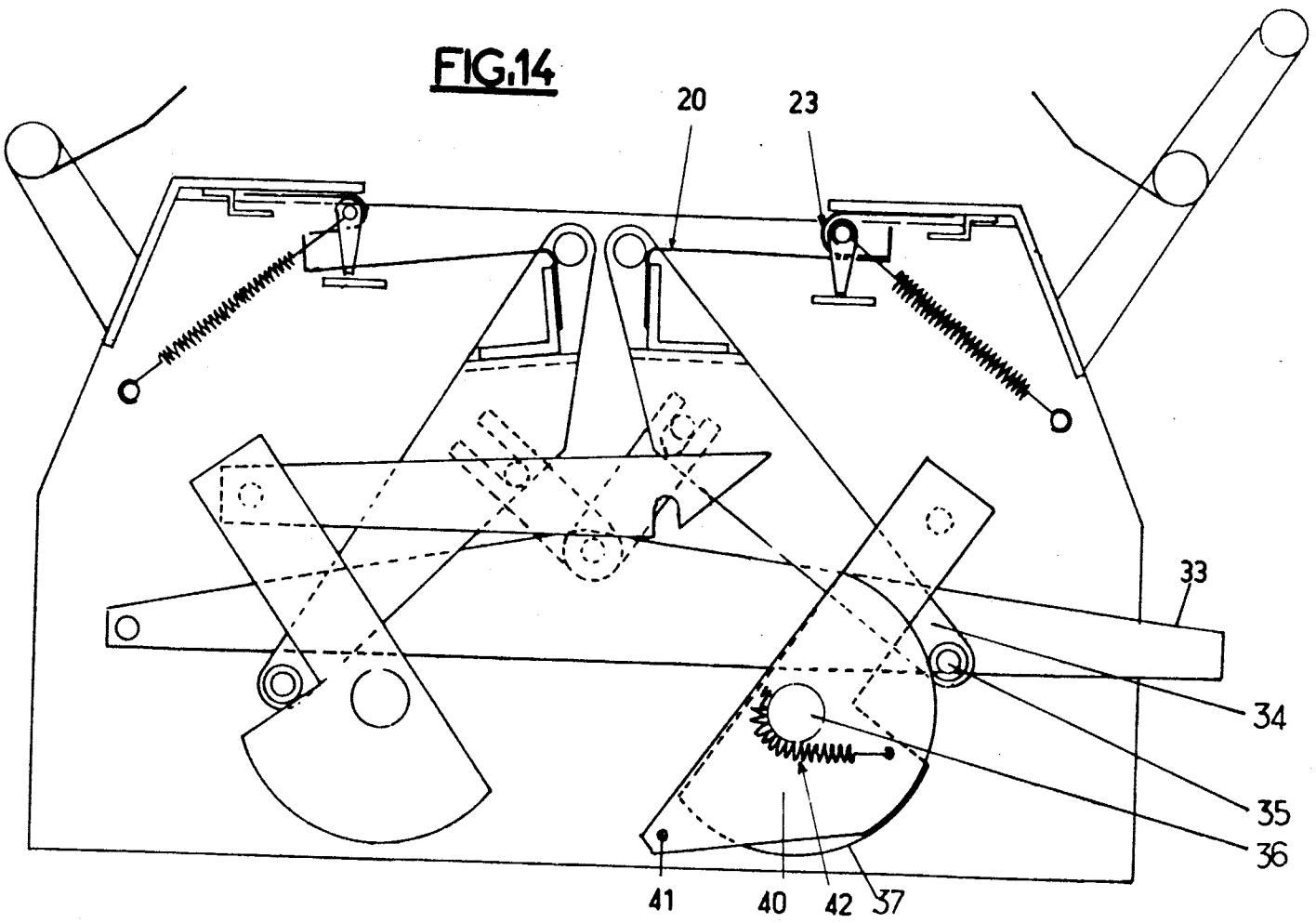
FIG. 14 is a view similar to FIGS. 3 to 7 showing another variant and another operating stage.

For making the second fold the front blade-holder arm 27 is pulled back by the user and in its return movement it brings the back blade-holder arm 11 with it. During this joint return movement of the blade-holder arms 27 and 11, the half-platen 17 is raised in its turn by cam 3, which pushes through roller 4 the lever 5 controlling the half-platen 17 so that the half-platen 17 is in turn firmly pressed against presser 14 against which it holds the fold that has just been made and which is thus formed and squeezed. Regarding this it will be noted that the build up in the thickness of the successive document folds to be formed is taken up by the self-flexibility of the half-platens. In this state of FIG. 6 at the end of the stroke, it can also be observed that it is then the half-platen 20 which is left free to swing so as to allow the penetration, between the half-platen 20 and the presser of the fold formed by means the blade 12 of the blade-holder arm 11. The blade 12 in turn inserts itself between the presser 23 and the half-platen, pushing stay 22 off its support on seating 21. At the end of the folding operation, starting from a position shown as in FIG. 7, lever 33 is raised manually. Through its central pin 38 it raises the latch 39 which unlocks the back 11 and front 27 blade-holder arms; the latter is then brought back (lever 33 side). The lifting of lever 33 has at the same time, via the central pin 38 and levers 8, 30, raised the half-platens against the pressers 24 and 23, which has allowed the stays 15 and 22 to return and be supported on the seatings 16 and 21 as shown in FIG. 7. The folded document can then easily be removed, since its folds are no longer compressed, and it is easy to grasp since it is possible to pass the fingers underneath from the side, owing to the space remaining between the half-platens 17 and 20. At this stage, since the blade-holder arm 27 has been brought towards the user, the machine is again in the initial position shown in FIG. 1, i.e. ready for a new folding operation. FIGS. 5 and 14 show, as variants and as additional fittings, auxiliary means designed to partly allow for foot control or drive of the machine, which also eases two-handed operation by the user. This additional system consists of a cam 40 mounted to rotate freely round the hinge pin 36 and fitted with a return spring 42 placed between it and pin 36, whilst a cable 41 connects this cam 40 to a foot control pedal not shown. With this arrangement, at the beginning of the operation with the machine assumed to be in the position shown in FIG. 3, with cam 40 in the position shown in FIG. 5, the drawing can be inserted beneath presser 23 as has already been explained. This is the moment when the user can operate the foot control which, via the cable 41, brings cam 40 into the position shown in FIG. 14. This results in the lever 34 controlling the half-platen 20 so that this half-platen comes and presses the end of the drawing originally inserted beneath presser 23 against the presser. The user, who has just inserted this drawing by hand can then let it go and use both his hands to operate the arm 27 with its operating handle 26 as set out above. When cam 37 (the diameter of which is slightly greater than the diameter of cam 40) comes into contact with roller 35 on lever 34, cam 40, which is in fact held in position by the pressure of roller 35 on it, even if the pedal is no longer pressed, is released and returned to its initial position by the return spring 42 (position shown in FIG. 5). This foot control is, like the operation of lever 33 explained previously, only used at the start of the folding operation in order to hold the drawing in position for forming the first fold. Of course other variants may be thought up whilst still remaining within the scope of the invention.

I claim:

1. A machine for folding a sheet of flexible material, said machine comprising (1) means for defining two spaced apart folding and stop surfaces; (2) two corresponding fold-forming and fold-holding presser components respectively associated with said folding and stop surfaces; (3) a pair of blades; (4) support means for respectively supporting said blades in a mutually opposing relationship; and (5) means for oscillating said blades so that said blades are movable each in a predetermined direction of movement to respectively cooperate with said two folding and stop surfaces and said presser components so as to alternatively form folds in said sheet, wherein the improvement comprises:

said means for defining said folding and stop surfaces respectively include a pair of half-platens;

means for movably mounting and biasing each of said presser components towards a respective one of said half-platens;

support means for pivotally mounting each of the said half-platens so that each of said half-platens is pivotable with respect to a corresponding one of said presser components about an axis substantially normal to the direction of movement of a corresponding one of said blades;

cam means mounted for rotation in response to movement of at least one of said blades;

lever means movable in response to the rotation of said cam means and cooperative with each of said half-platens so that as one of said blades moves toward a respective one of said half-platens and corresponding presser components, (a) said one-half platen and presser component are spaced from one another so that said blade can extend and fold said sheet inbetween said half-platen and presser component and (b) the other of said half-platens presses the portion of said sheet disposed between said other half-platen and corresponding other presser component against said other presser component.

2. The machine according to claim 1, wherein said means for movably mounting and biasing includes a spring for biasing each of said presser components towards a respective one of said half-platens.

3. The machine according to claim 1, further including stay means for maintaining each of said half-platens in a spaced-apart open position with respect to the corresponding presser components, said stay means for each of said half-platens being retractable in response to movement of the respective blade between the corresponding half-platen and presser component permitting the corresponding half-platen to move against the corresponding presser component during the formation of a fold in said sheet between said corresponding half-platen and presser component.

4. The machine according to claim 1, further including means for selectively coupling said blades so said blades move simultaneously.

5. The machine according to claim 1, further including foot control means for controlling the operation of said machine and second cam means, said second cam means being cooperative with said lever means, and said foot control means being mechanically coupled to said second cam means for rotating said second cam means so that one of said half-platens is moved towards and pressed against the corresponding presser component in response to said foot control means.

6. The machine according to claim 1, wherein said half-platens are spaced from one another so as to provide a space therebetween for facillitating the grasping of said sheet.

* * * * *